US007411562B2

(12) United States Patent
Lin

(10) Patent No.: US 7,411,562 B2
(45) Date of Patent: Aug. 12, 2008

(54) APPARATUS FOR SUPPORTING A SATELLITE ANTENNA DISH AND A SATELLITE RECEIVER

(76) Inventor: Ming-Tien Lin, No. 206, Cheng Kung 3rd Road, Nan Kang Industrial Park, Nantou City (TW)

( * ) Notice: Subject to any disclaimer, the term of this patent is extended or adjusted under 35 U.S.C. 154(b) by 140 days.

(21) Appl. No.: 11/583,172

(22) Filed: Oct. 19, 2006

(65) Prior Publication Data

US 2008/0099643 A1 May 1, 2008

(51) Int. Cl.
*H01Q 1/08* (2006.01)

(52) U.S. Cl. ..... 343/882; 343/881; 343/880; 248/176.1; 248/121

(58) Field of Classification Search ..... 343/880, 343/882, 881, 891; 248/284.1, 237, 121, 248/176.1, 278.1, 276.1
See application file for complete search history.

(56) References Cited

U.S. PATENT DOCUMENTS 5,807,017 A * 9/1998 Noble ..... 403/385
6,366,253 B1 * 4/2002 Hemmingsen, II ..... 343/760
6,445,361 B2 * 9/2002 Liu et al. ..... 343/882
6,762,731 B1 * 7/2004 Chou ..... 343/882
6,864,855 B1 * 3/2005 Fujita ..... 343/882
7,113,144 B2 * 9/2006 Lin et al. ..... 343/800
7,142,168 B1 * 11/2006 Sinclair ..... 343/882
7,268,743 B2 * 9/2007 Lin ..... 343/880
2005/0057428 A1 * 3/2005 Fujita ..... 343/882

* cited by examiner

*Primary Examiner*—Amy J. Sterling
(74) *Attorney, Agent, or Firm*—Rabin & Berdo, P.C.

(57) ABSTRACT

An apparatus for supporting a satellite antenna dish and a satellite receiver includes a supporting base, a connecting member and an extending bar. The supporting base includes a supporting board, a sidewall, multiple mounting tabs and a pivoting bracket. The supporting board has an edge and multiple curved slots. The sidewall is formed on the edge of the supporting board and has an edge. The mounting tabs are formed on the edge of the sidewall. The pivoting bracket is mounted on the sidewall and has a mounting hole defined through the pivoting bracket. The connecting member is mounted pivotally on the pivoting bracket on the supporting base. The extending bar is connected to the connecting member and has a connecting end mounted on the connecting bar and a mounting end.

4 Claims, 7 Drawing Sheets

APPARATUS FOR SUPPORTING A SATELLITE ANTENNA DISH AND A SATELLITE RECEIVER

BACKGROUND OF THE INVENTION

1. Field of Invention

The present invention relates to a supporting apparatus, and more particularly to an apparatus for supporting a satellite antenna dish and a satellite receiver and that can be folded and packed conveniently.

2. Description of the Related Art

A satellite antenna is used to receive satellite signals such as telephone, television and radio signals and comprises a satellite antenna dish, a satellite receiver and a supporting apparatus. The satellite antenna dish can reflect and transmit satellite signals. The satellite receiver is used to receive satellite signals. The supporting apparatus is mounted between the satellite antenna dish and the satellite receiver and is capable to adjust an angular position of the satellite antenna dish.

With reference to FIG. 7, a conventional supporting apparatus comprises a supporting base (70) and a connecting bar (71). The supporting base (70) is attached to the satellite antenna dish. The connecting bar (71) has a connecting end and a mounting end. The connecting end of the connecting bar (71) is connected to the supporting base (70). The mounting end of the connecting bar (71) is attached to the satellite receiver.

However, because the conventional supporting apparatus cannot be folded, the conventional supporting apparatus occupies a large space and cannot be stores and transported easily. When the conventional supporting apparatus is transported and stored, the conventional supporting apparatus must be detached from the satellite receiver and packed separately in a flat condition to reduce the space for transporting and prevent the conventional supporting apparatus from bumping with external objects. This is quite inconvenient and time-consuming.

To overcome the shortcomings, the present invention provides an apparatus for supporting a satellite antenna dish and a satellite receiver to mitigate or obviate the aforementioned problems.

SUMMARY OF THE INVENTION

The primary objective of the present invention is to provide an apparatus for supporting a satellite antenna dish and a satellite receiver that can be folded conveniently and can be stored and transported easily.

The apparatus for supporting a satellite antenna dish and a satellite receiver comprises a supporting base, a connecting member and an extending bar. The supporting base comprises a supporting board, a sidewall, multiple mounting tabs and a pivoting bracket. The supporting board has an edge and multiple curved slots. The curved slots of the supporting are defined through the supporting board and are arranged in a circle. The sidewall is formed on the edge of the supporting board and has an edge. The mounting tabs are formed on the edge of the sidewall. The pivoting bracket is mounted on the sidewall and has a mounting hole defined through the pivoting bracket.

The connecting member is mounted pivotally on the pivoting bracket on the supporting base and has a mounting hole and a mounting bolt. The mounting hole is defined through the connecting member and is aligned with the mounting hole in the pivoting bracket. The mounting bolt is extended through and mounted in the mounting holes in the pivoting bracket and the connecting member.

The extending bar is connected to the connecting member and has a connecting end mounted on the connecting bar and a mounting end.

Preferably, the pivoting bracket further has a positioning button formed on the pivoting bracket. The connecting member further has a positioning hole defined through the mounting section of the connecting member and is engaged with the positioning button on the pivoting bracket.

Preferably, the pivoting bracket further has a U-shaped cross-section, a central segment, two side segments and two pivoting holes. The pivoting holes of the pivoting bracket are defined respectively through the side segments of the pivoting bracket and are aligned with each other. The connecting member is L-shaped and further has a U-shaped cross-section, a mounting section, a connecting section, two pivoting holes and two pivoting bolts. The mounting section of the connecting member has a central segment and two side segments. The pivoting holes are defined respectively through the side segments of the mounting section of the connecting member and are aligned respectively with the pivoting holes in the side segments of the pivoting bracket. The pivoting bolts are extended respectively through the pivoting holes in the side segments of the pivoting bracket and the mounting section of the connecting member.

Other objectives, advantages and novel features of the invention will become more apparent from the following detailed description when taken in conjunction with the accompanying drawings.

DETAILED DESCRIPTION OF THE INVENTION

Figure 1:
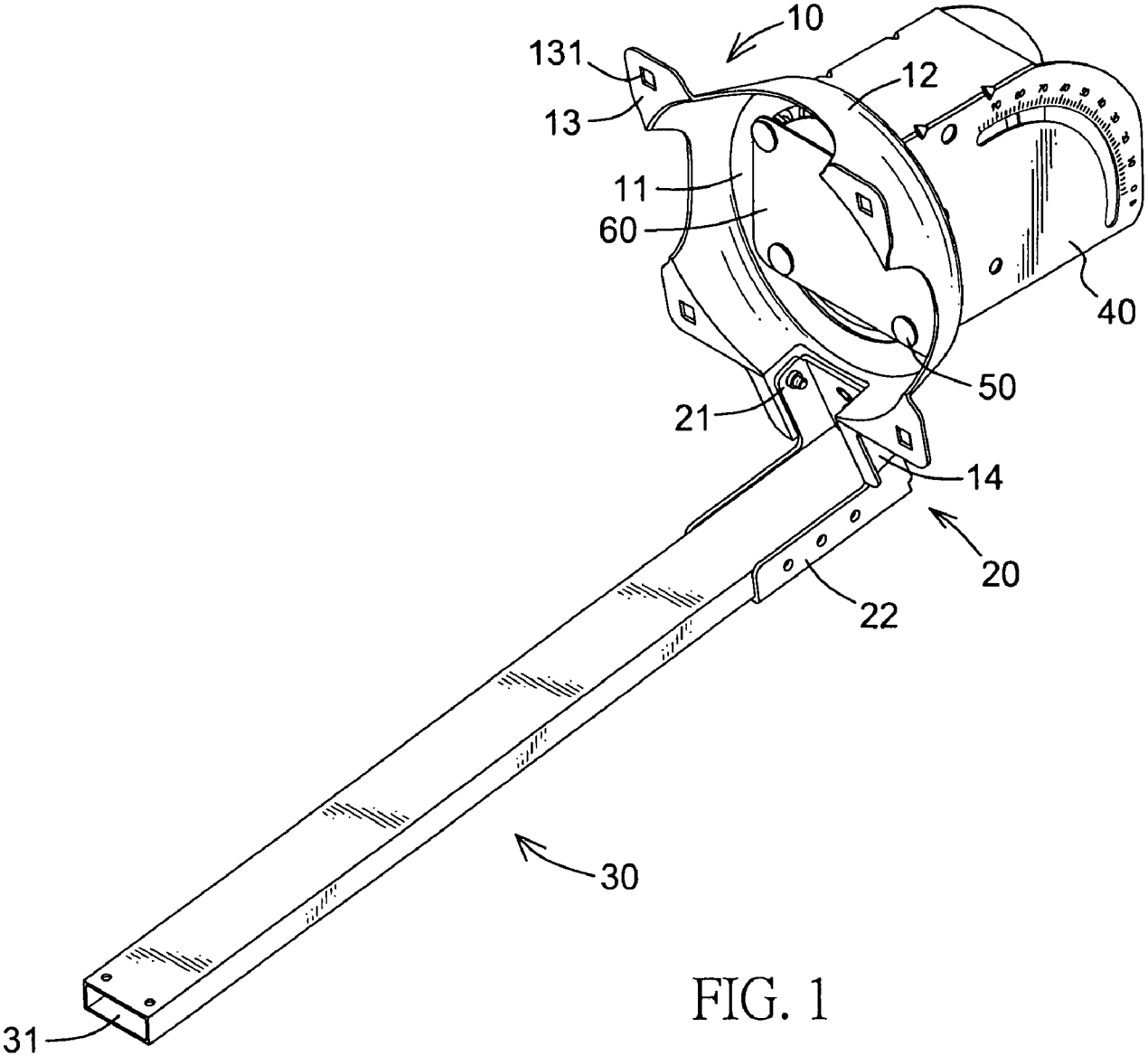
FIG. 1 is a perspective view of an apparatus for supporting a satellite antenna dish and a satellite receiver in accordance with the present invention with an adjusting member.
Figure 2:
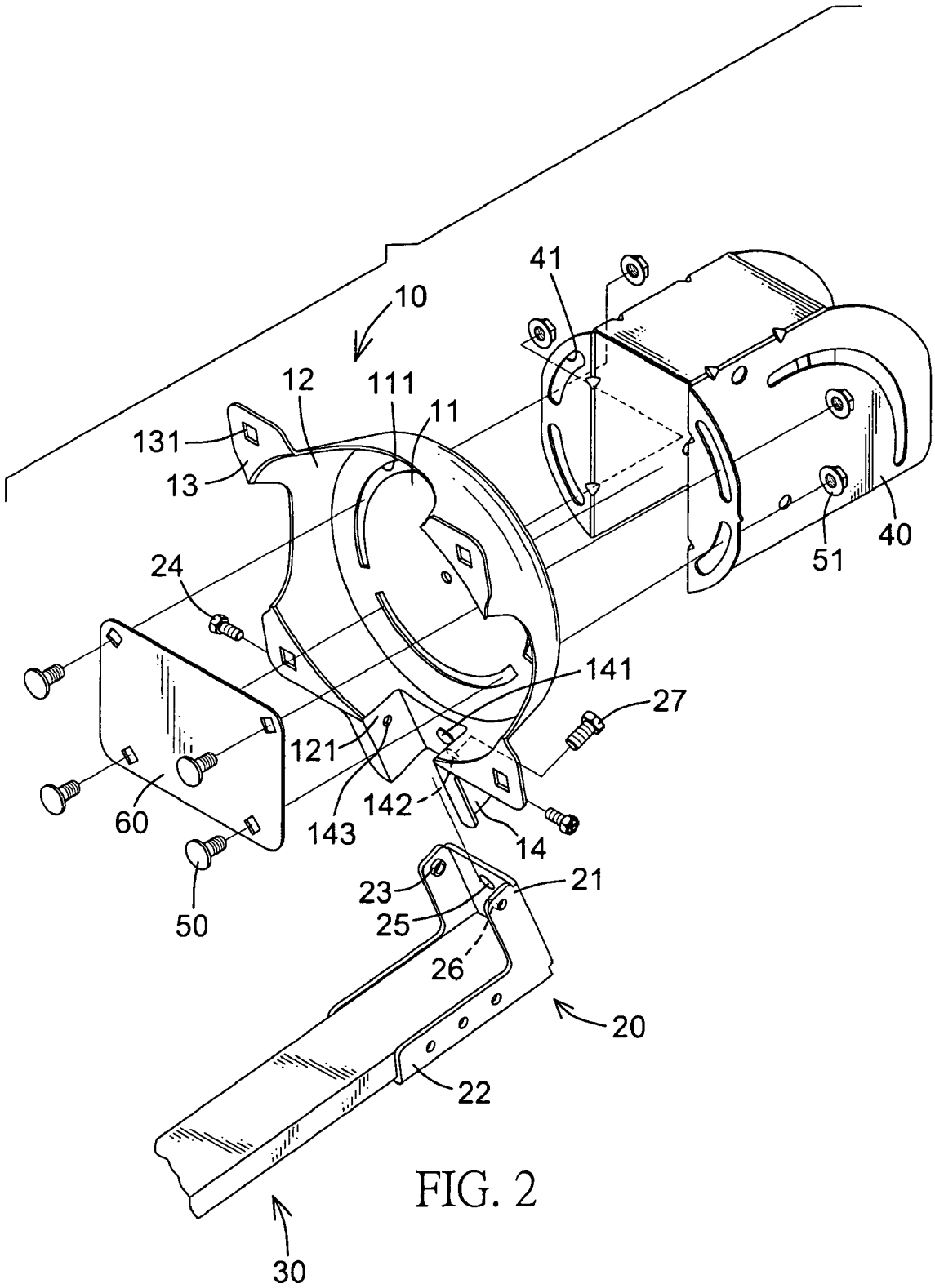
FIG. 2 is an exploded perspective view of the apparatus in FIG. 1.
Figure 3:
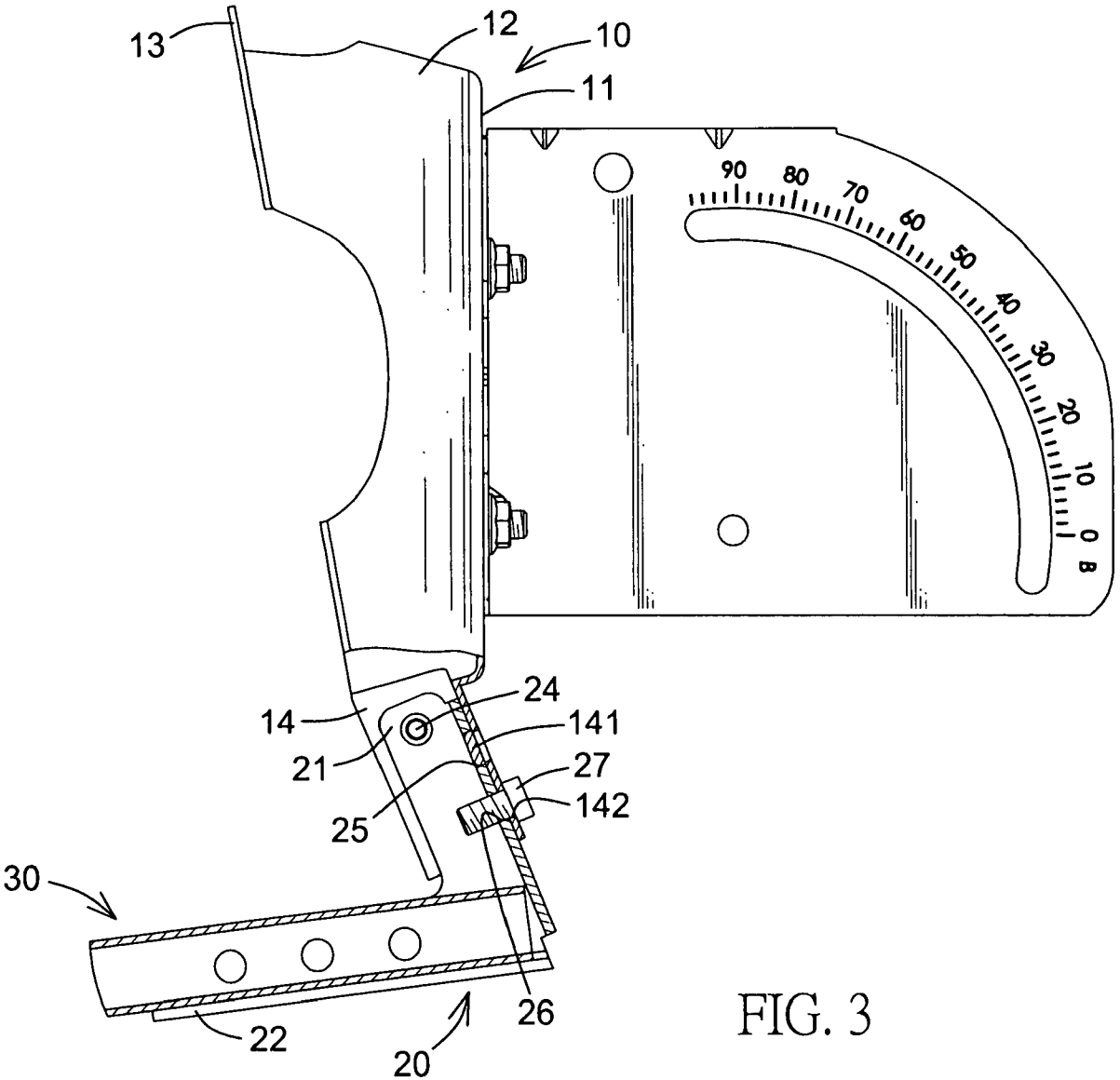
FIG. 3 is an enlarged side view in partial section of the apparatus in FIG. 1.
Figure 4:
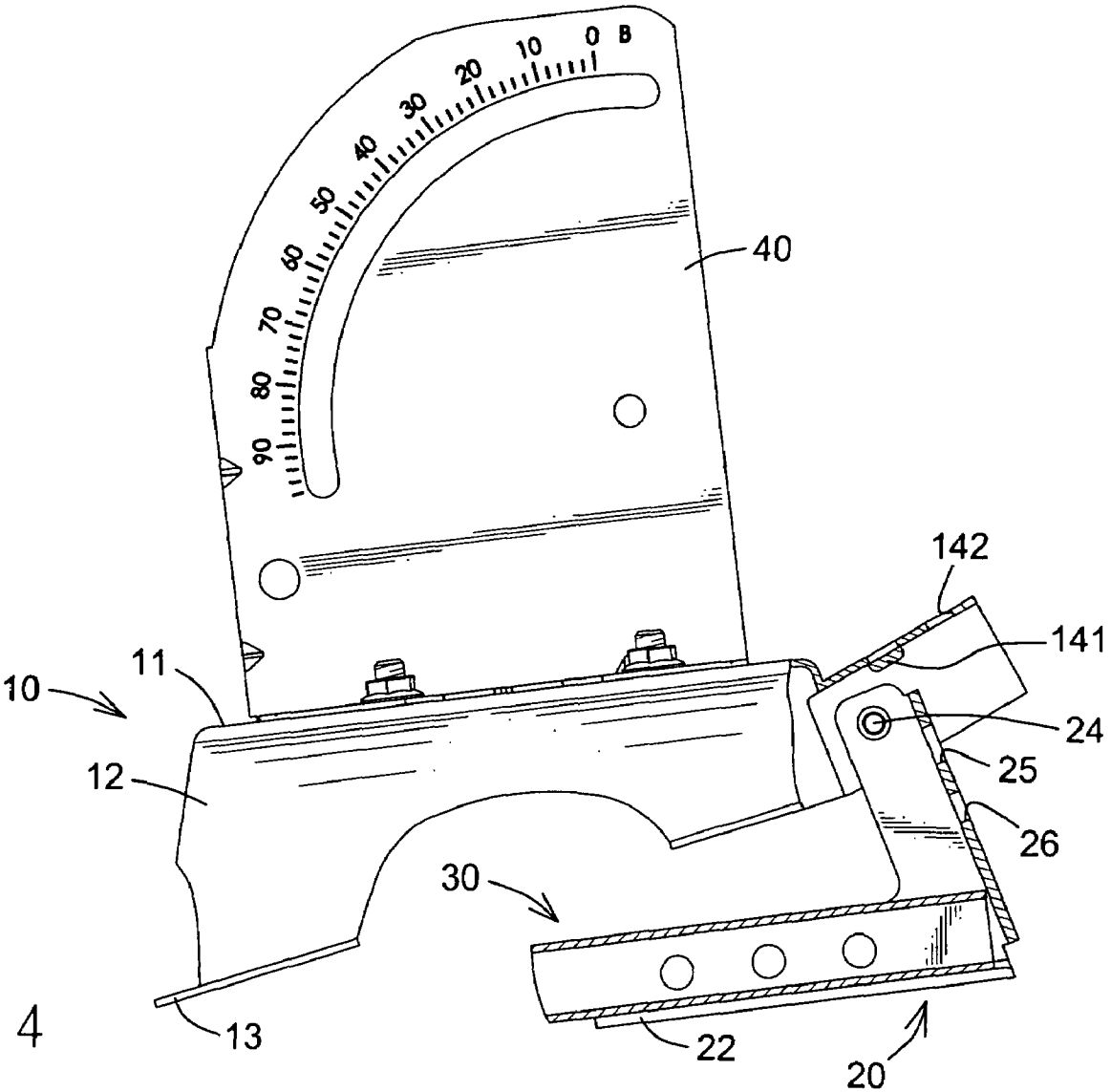
FIG. 4 is an operational enlarged side view in partial section of the apparatus in FIG. 1 with the supporting base being pivoted.

With reference to FIGS. 1, 2, 3 and 4, an apparatus for supporting a satellite antenna dish and a satellite receiver in accordance with the present invention comprises a supporting base (10), a connecting member (20) and an extending bar (30).

The supporting base (10) is used to support the satellite antenna dish and comprises a supporting board (11), a sidewall (12), multiple mounting tabs (13) and a pivoting bracket (14). The supporting board (11) has an edge and multiple curved slots (111). The curved slots (111) are defined through the supporting board (11) and are arranged in a circle. The sidewall (12) is formed on the edge of the supporting board (11) and has an edge and a notch (121). The notch (121) is defined through the sidewall (12). The mounting tabs (13) are formed on the edge of the sidewall (12) at intervals and are parallel with the supporting board (11) and each mounting tab (13) has a mounting hole (131). The mounting hole (131) of the mounting tab (13) is defined through the mounting tab (13) for mounting the satellite antenna dish.

The pivoting bracket (14) is mounted on the sidewall (12) around the notch (121) in the sidewall (12) and has a U-shaped cross-section, a central segment, two side segments, a positioning button (141), a mounting hole (142) and two pivoting holes (143). The positioning button (141) is formed on the central segment of the pivoting bracket (14). The mounting hole (142) is defined through the central segment of the pivoting bracket (14). The pivoting holes (143) are defined respectively through the side segments of the pivoting bracket (14) and are aligned with each other.

The connecting member (20) is L-shaped, is mounted pivotally on the pivoting bracket (14) on the supporting base (10) and has a U-shaped cross-section, a mounting section (21), a connecting section (22), two pivoting holes (23), two pivoting bolts (24), a positioning hole (25), a mounting hole (26) and a mounting bolt (27). The mounting section (21) of the connecting member (20) is mounted in the pivoting bracket (14) and has a central segment and two side segments. The pivoting holes (23) are threaded holes, are defined respectively through the side segments of the mounting section (21) of the connecting member (20) and are aligned respectively with the pivoting holes (143) in the side segments of the pivoting bracket (14). The pivoting bolts (24) are extended respectively through the pivoting holes (143) in the side segments of the pivoting bracket (14) and are screwed respectively into the mounting holes (23) in the mounting section (21) of the connecting member (20). The positioning hole (25) is defined through the central segment of the mounting section (21) of the connecting member (20) and is engaged with the positioning button (141) on the central segment of the pivoting bracket (14) to hold the connecting member (20) in position relative to the pivoting bracket (14). The mounting hole (26) is a threaded hole, is defined through the central segment of the mounting section (21) of the connecting member (20) and is aligned with the mounting hole (142) in the central segment of the pivoting bracket (14). The mounting bolt (27) is extended through the mounting hole (142) in the central segment of the pivoting bracket (14) and is screwed into the mounting hole (26) in the mounting section (21) of the connecting member (20).

The extending bar (30) is connected to the connecting member (20) and has a connecting end and a mounting end (31). The connecting end of the extending bar (30) is secured to the connecting section (22) of the connecting member (20) with fasteners. The mounting end (31) is connected to the satellite receiver.

When the apparatus is in use, an adjusting member is mounted on the supporting base (10) to allow the apparatus to adjust an angular position of the satellite antenna dish and has an adjusting base (40), a fastening board (60) and four fastening bolts (50) and four fastening nuts (51). The adjusting base (40) has a mounting end and two flanges. The flanges are formed on the mounting end of the adjusting base (40), are mounted on the supporting board (11) of the supporting base (10) and each has two curved slots (41). Each curved slot (41) is defined through a corresponding one of the flanges and is aligned with one of the curved slots (111) in the supporting board (11) of the supporting base (10). The fastening board (60) is attached to the supporting board (11) of the supporting base (10) and has four through holes. The through holes are defined through the fastening board (60) and correspond respectively to the curved slots (41) in the flanges of the adjusting base (40). Each fastening bolt (50) is extended through one of the through holes in the fastening board (60), one of the curved slots (111) in the supporting board (11) of the supporting base (10) and one of the curved slots (41) in the flanges of the adjusting base (40). Each fastening nut (51) is engaged with one of the fastening bolts (50) and abuts with one of the flanges of the adjusting base (40). So the supporting board (11) of the supporting base (10) is clamped by the fastening board (60) and adjusting base (40) of the adjusting member. When the fastening nuts (51) of the adjusting member are unscrewed, the adjusting base (40) is released and can rotate relative to the supporting board (11) of the supporting base (10).

Figure 5:
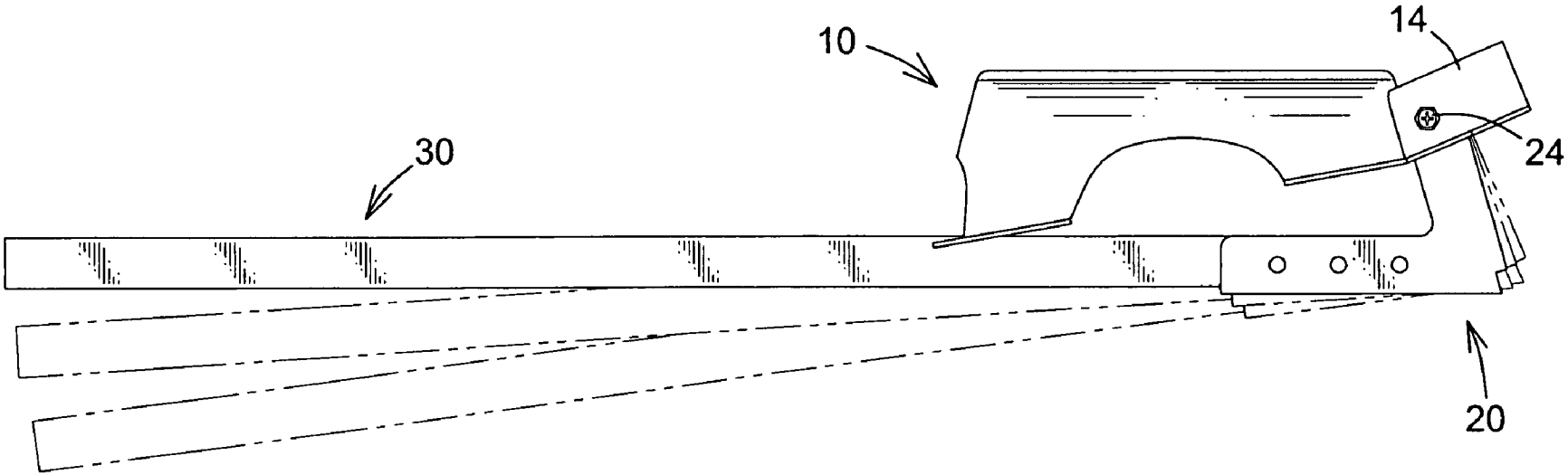
FIG. 5 is an operational side view of the apparatus with the connecting member being pivoted.
Figure 6:
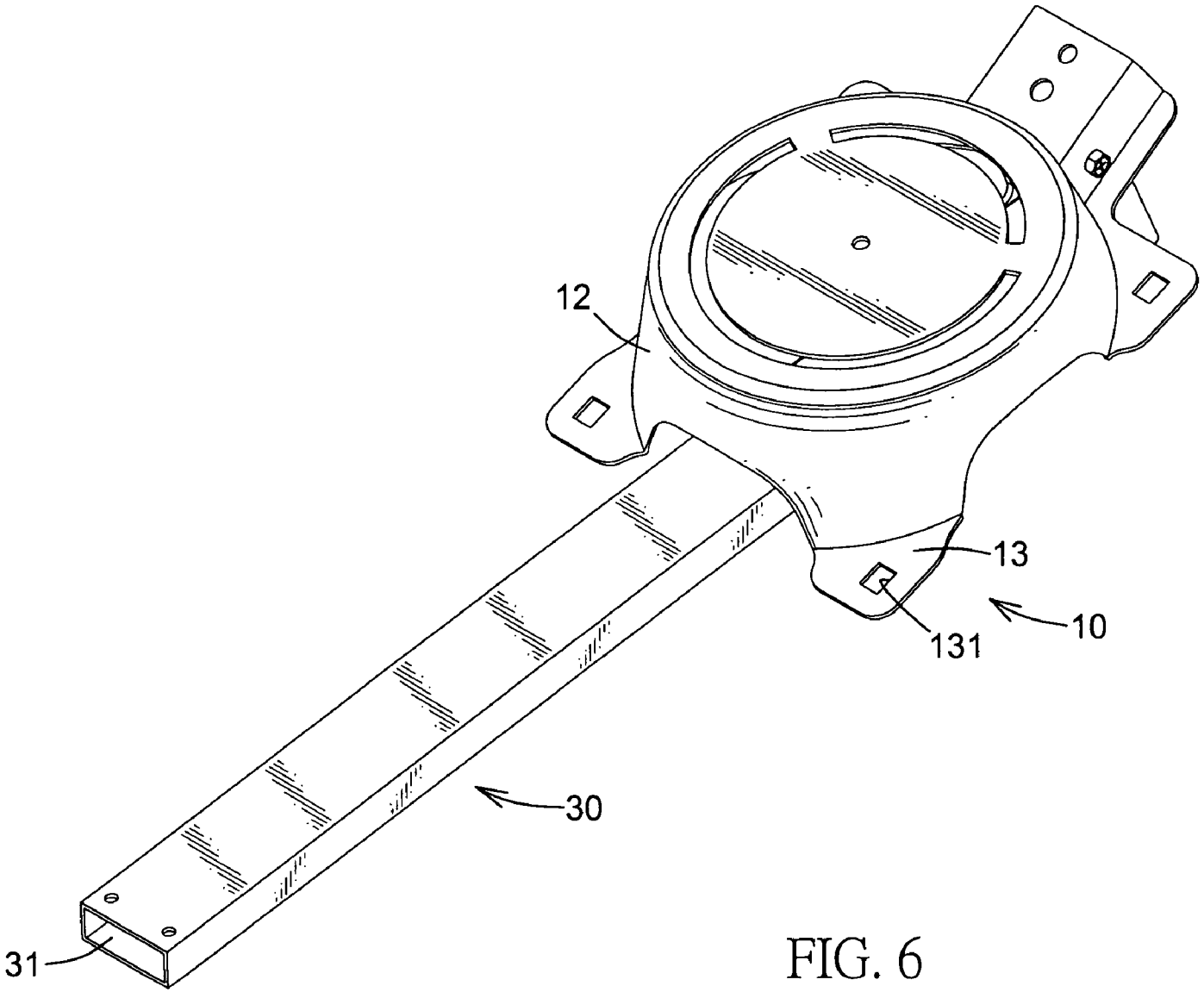
FIG. 6 is a perspective view of the apparatus with the apparatus in FIG. 1 being folded.
Figure 7:
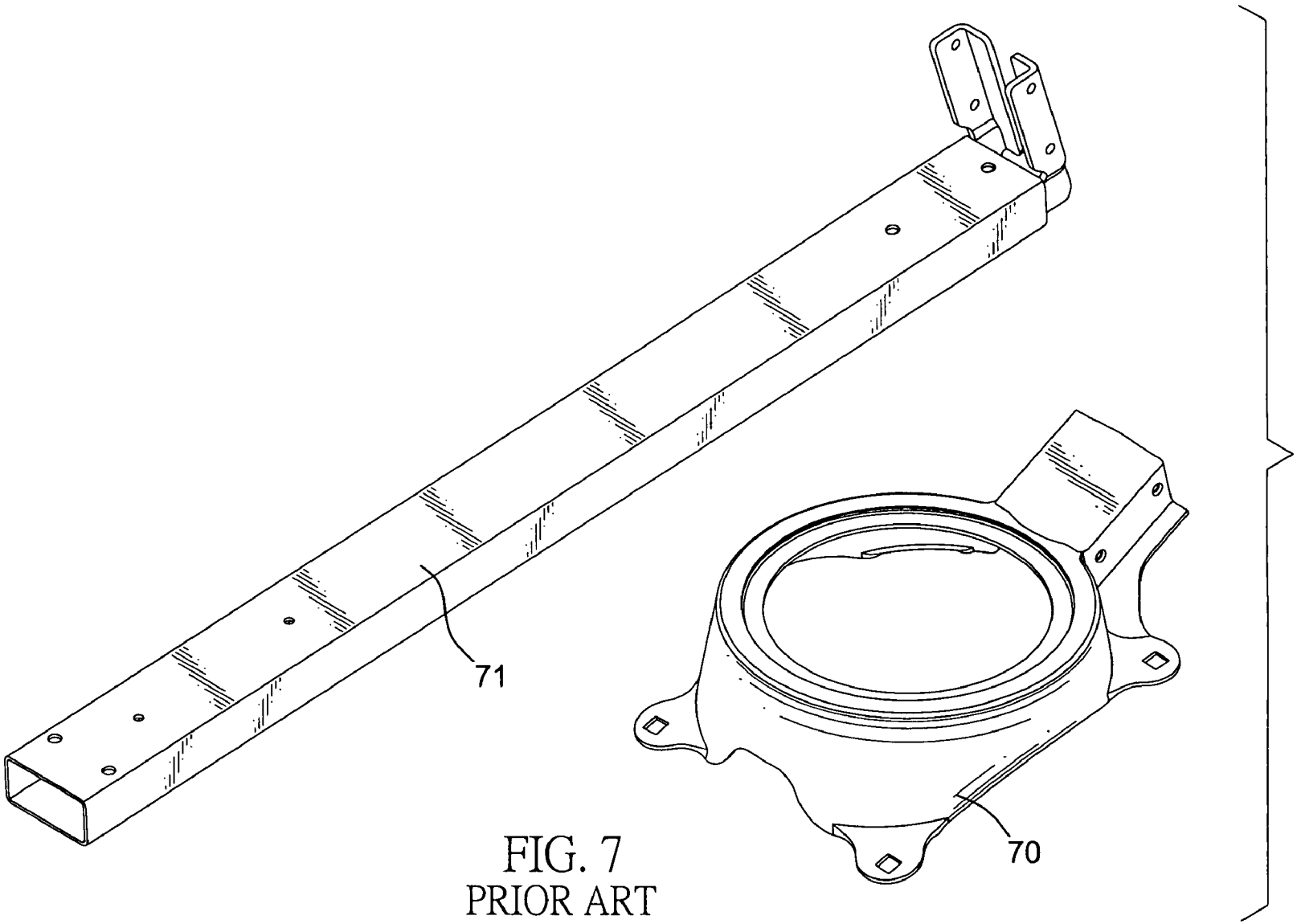
FIG. 7 PRIOR ART
FIG. 7 is an exploded perspective view of a conventional supporting apparatus in accordance with the prior art.

With further reference to FIGS. 5 and 6, when the apparatus is folded, the mounting bolt (27) of the connecting member (20) is unscrewed from the mounting hole (26) in the mounting section (21) and the supporting base (10) can be pivoted relative to the connecting member (20). Then, the supporting base (10) is pushed to remove the positioning button (141) on the pivoting bracket (14) in the supporting base (10) from the positioning hole (25) on the mounting section (21) of the connecting bar (20) and is pivoted toward the extending bar (30). So the apparatus is folded and is in a flat condition without detaching the supporting base (10) and volume of the folded apparatus is reduced. Accordingly, the apparatus can be folded easily to reduce the volume of the apparatus and can be stored and transported conveniently.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An apparatus for supporting a satellite antenna dish and a satellite receiver comprising a supporting base comprising a supporting board having an edge; and multiple curved slots being defined through the supporting board and arranged in a circle;

a sidewall being formed on the edge of the supporting board and having an edge;

multiple mounting tabs being formed on the edge of the sidewall; and a pivoting bracket being mounted on the sidewall and having a mounting hole being defined through the pivoting bracket;

a connecting member being mounted pivotally on the pivoting bracket on the supporting base and having a mounting hole being a threaded hole, being defined through the connecting member and aligned with the mounting hole in the pivoting bracket; and a mounting bolt being extended through the mounting hole in the pivoting bracket and screwed into the mounting hole in the connecting member; and an extending bar being connected to the connecting member and having a connecting end being mounted on the connecting bar; and a mounting end.

2. The apparatus for supporting a satellite antenna dish and a satellite receiver as claimed in claim 1, wherein the pivoting bracket further has a positioning button formed on the pivoting bracket; and the connecting member further has a positioning hole defined through the connecting member and detachably engaged with the positioning button on the pivoting bracket.

3. The apparatus for supporting a satellite antenna dish and a satellite receiver as claimed in claim 2, wherein the pivoting bracket further has a U-shaped cross-section;

a central segment, wherein the mounting hole of the pivoting bracket is defined through the central segment of the pivoting bracket;

two side segments; and two pivoting holes being defined respectively through the side segments of the pivoting bracket and aligned with each other; and the connecting member is L-shaped and further has a U-shaped cross-section, a mounting section having a central segment, wherein the mounting hole of the connecting member is defined through the central segment of the mounting section of the connecting member; and two side segments;

a connecting section;

two pivoting holes being threaded holes, being defined respectively through the side segments of the mounting section of the connecting member and aligned respectively with the pivoting holes in the side segments of the pivoting bracket; and two pivoting bolts being extended respectively through the pivoting holes in the side segments of the pivoting bracket and screwed respectively into the pivoting holes in the mounting section of the connecting member.

4. The apparatus for supporting a satellite antenna dish and a satellite receiver as claimed in claim 3, wherein the sidewall of the supporting base further has a notch defined through the sidewall; and the pivoting bracket is mounted on the sidewall around the notch in the sidewall of the supporting base.

* * * * *